United States Patent [19]

Kadija

[11] 4,278,524

[45] Jul. 14, 1981

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 106,219

[22] Filed: Dec. 21, 1979

Related U.S. Application Data

[63] Continuation-in-part of Ser. No. 836,636, Sep. 26, 1977, Pat. No. 4,184,939, and Ser. No. 947,235, Sep. 29, 1978, Pat. No. 4,207,163.

[51] Int. Cl.[3] ..... C25B 13/04

[52] U.S. Cl. ..... 204/252; 204/295; 204/296

[58] Field of Search ..... 204/295, 296, 252, 251

[56] References Cited

U.S. PATENT DOCUMENTS

| | | | |
|---|---|---|---|
| 3,923,630 | 12/1975 | Argade et al. | 204/266 |
| 4,184,939 | 1/1980 | Kadija | 204/252 |

*Primary Examiner*—F. Edmundson

*Attorney, Agent, or Firm*—James B. Haglind; Donald F. Clements

[57] ABSTRACT

A diaphragm for use in the electrolysis of aqueous solutions of ionizable compounds in electrolytic diaphragm cells is comprised of a support fabric impregnated with particles of an inorganic clay of the montmorillonite group.

The diaphragms are physically and chemically stable, provide reduced cell voltages during operation of the cell and having increased operational life.

14 Claims, 9 Drawing Figures

DIAPHRAGMS FOR USE IN THE ELECTROLYSIS OF ALKALI METAL CHLORIDES

This application is a continuation-in-part of co-pending applications U.S. Ser. No. 836,636, filed Sept. 26, 1977; now U.S. Pat. No. 4,184,939 issued Jan. 22, 1980 and U.S. Ser. No. 947,235, filed Sept. 29, 1978 now U.S. Pat. No. 4,207,163, issued June 10, 1980.

This invention relates to diaphragm-type electrolytic cells for the electrolysis of aqueous salt solutions. More particularly, this invention relates to novel diaphragms for electrolytic diaphragm cells.

For years, commercial diaphragm cells have been used for the production of chlorine and alkali metal hydroxides such as sodium hydroxide which employed a porous diaphragm of asbestos fibers. In employing asbestos diaphragms, it is thought that the effective diaphragm is a gel layer formed within the asbestos mat. This gel layer is formed by the decomposition of the asbestos fibers. In addition to undergoing chemical decomposition during operation of the cell when electrolyzing alkali metal chloride solutions, the asbestos fibers also suffer from dimensional instability as they are distorted by swelling. Porous asbestos diaphragms while satisfactorily producing chlorine and alkali metal hydroxide solutions, have limited cell life and once removed from the cell, cannot be re-used. Further asbestos has now been identified by the Environmental Protection Agency of the U.S. Government as a health hazard.

Therefore there is a need for diaphragms having increased operating life while employing materials which are durable as well as inexpensive.

It is an object of the present invention to provide a diaphragm having increased stability and a longer operational life when employed in the electrolysis of alkali metal chloride solutions.

Another object of the present invention is the use of ecologically acceptable non-polluting materials in diaphragm compositions.

Yet another object of the present invention is to provide a diaphragm having reduced resistance to electric current.

An additional object of the present invention is to provide a diaphragm having support materials which are chemically and physically stable during electrolysis.

A further object of the invention is the production of diaphragms having reduced costs for materials.

A still further object of the present invention is to provide a diaphragm which can be handled easily during installation in and removal from the electrolytic cell.

Still another object of the present invention is to provide a diaphragm which serves as a suitable replacement for asbestos diaphragms and which can be used with existing cells and brine supplies employing known operating procedures.

These and other objects of the invention will be apparent from the following description of the invention.

Briefly, the novel porous diaphragm of the present invention for an electrolytic cell for the electrolysis of alkali metal chloride brines comprises a support fabric impregnated with an inorganic clay of the monmorillonite group.

Accompanying FIGS. 1–9 illustrate the novel diaphragm of the present invention.

Figure 1:
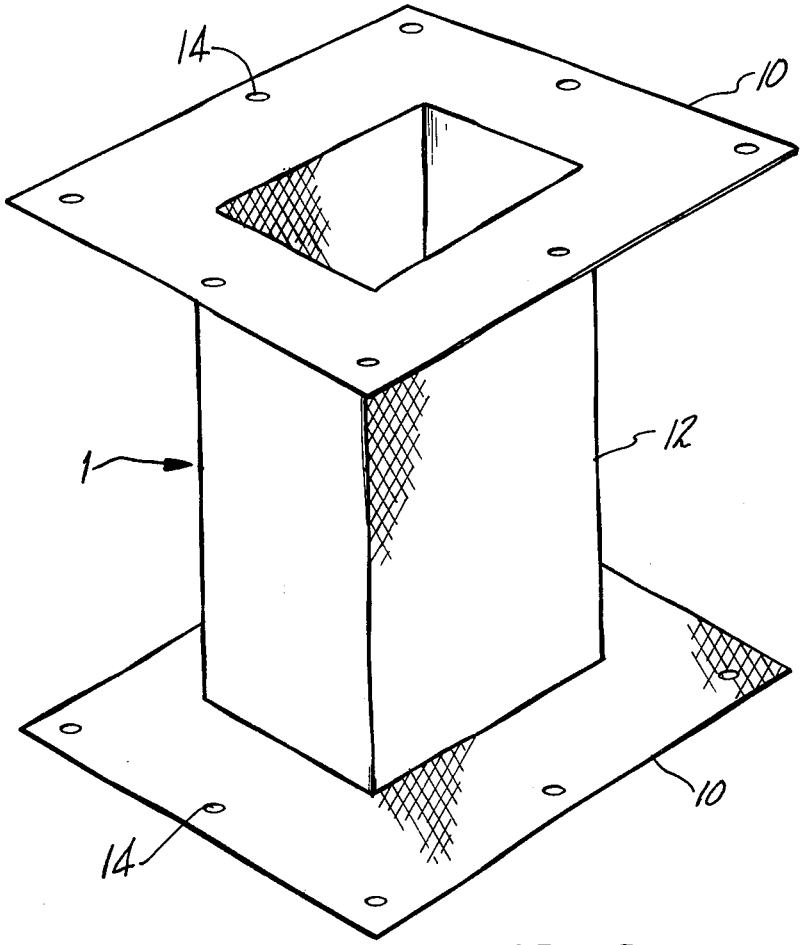
FIG. 1 illustrates a perspective view of one embodiment of the diaphragm of the present invention.

FIG. 1 illustrates a diaphragm of the present invention suitable for covering a cathode. Diaphragm 1, comprised of fabric, has end portions 10 attached, for example, by sewing, to diaphragm body 12. Diaphragm body 12 is a hollow rectangle which is mounted on a cathode (not shown) so that it surrounds the cathode on all sides. End portions 10 have openings 14 which permit end portions 10 to be attached to the cell walls (not shown).

Figure 2:
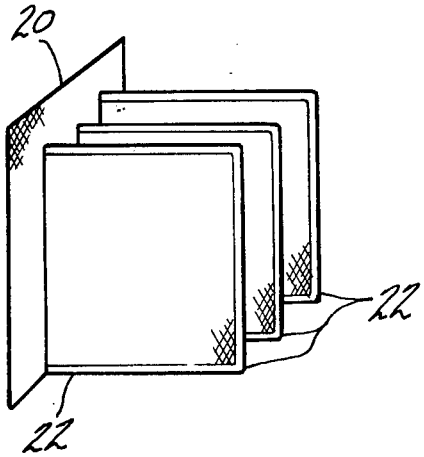
FIG. 2 shows a perspective view of one embodiment of the diaphragm of the present invention suitable for use with a plurality of electrodes.

FIG. 2 depicts a diaphragm suitable for use with a plurality of electrodes. Fabric panel 20 has fabric casings 22 attached substantially perpendicular to the plane of panel 20. Fabric casings 22 are suitably spaced apart from each other and are attached to fabric panel 20, for example, by sewing. Fabric panel 20 has openings (not shown) corresponding to the area where fabric casings 22 are attached to permit the electrodes to be inserted in fabric casings 22.

Figure 3:
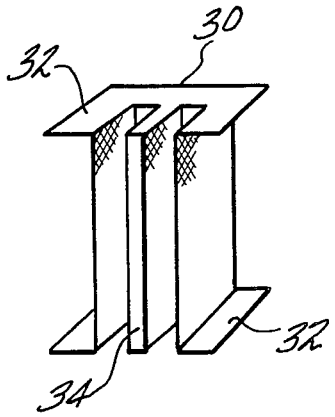
FIG. 3 depicts a perspective view of an additional embodiment of the diaphragm of the present invention for use with a plurality of electrodes.

FIG. 3 illustrates another embodiment of the diaphragm of the present invention. U-shaped fabric panel 30 has end portions 32 for attachment to the cell walls (not shown). Fabric casing 34 is attached to U-shaped fabric panel 30, for example, by sewing. An opening (not shown) along the bottom edge of fabric casing 34 permits the diaphragm to be installed on a vertically positioned electrode.

Figure 4:
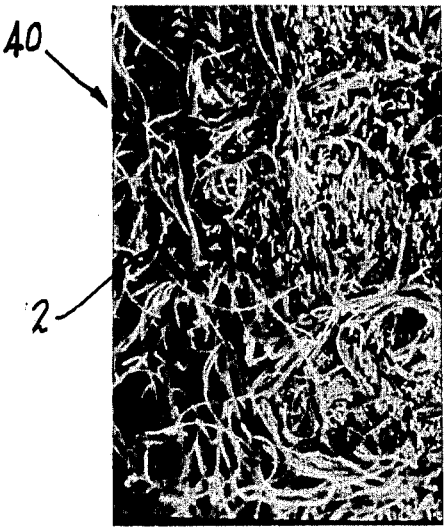
FIG. 4 is a photomicrograph of a cross section of one embodiment of the support fabric employed in the diaphragms of the present invention (magnified 30 times).

FIG. 4 shows a cross section of a polytetrafluoroethylene felt support fabric 40 of the present invention having fibers 42 randomly oriented.

Figure 5:
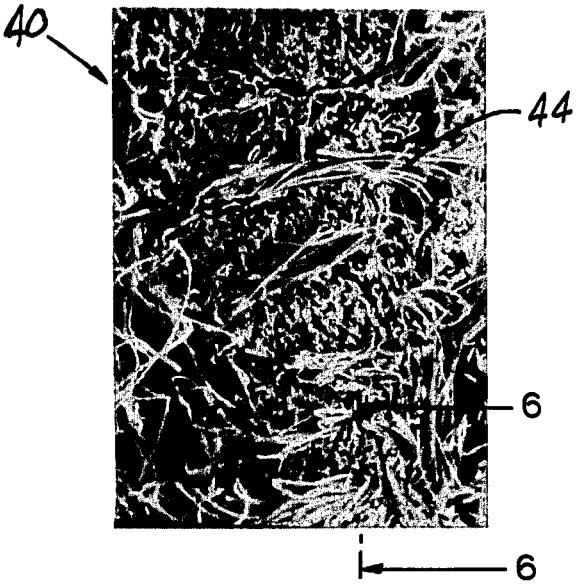
FIG. 5 is a photomicrograph of a planar cross section of an embodiment of the support fabric having fiber bundles (magnified 30 times).

The embodiment of the support fabric 40 illustrated in FIG. 5 has, at regular intervals, fiber bundles 44 which are substantially perpendicular to the plane of the outer surface of fabric 40. Fiber bundles 44 penetrate the entire width of support fabric 40. The support fabric is a polytetrafluoroethylene felt fabric where the magnification shown in the photomicrograph is 30 times the original.

Figure 6:
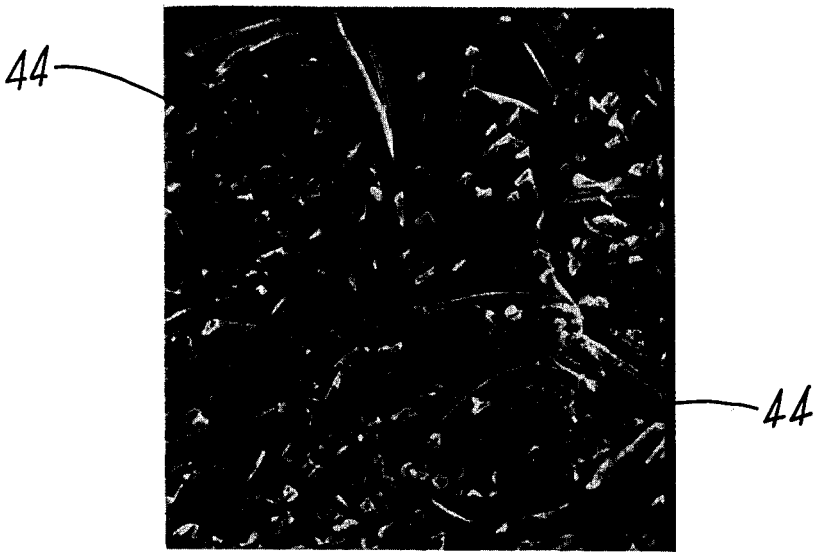
FIG. 6 is a cross section of FIG. 5 taken along line 6—6.

FIG. 6 illustrates fiber bundles 44 found in a cross section of FIG. 5 along line 6—6 where the magnification is 120 times.

Figure 7:
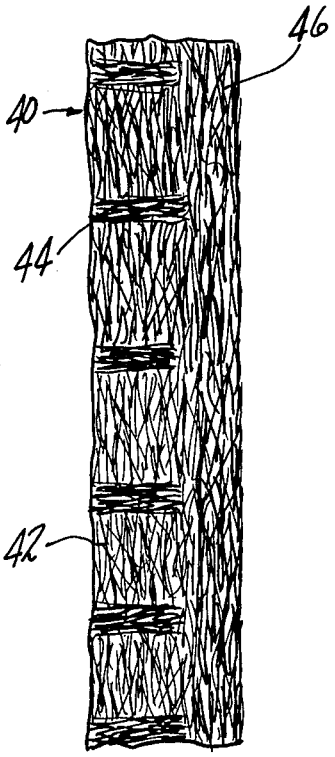
FIGS. 7–9 illustrate a cross section of several embodiments of the support fabric.

Portrayed in FIG. 7 is an embodiment of support fabric 40 in which fiber clusters 44 only partially penetrate the support fabric leaving section 46 having fibers 42 generally oriented in a vertical direction.

Figure 8:
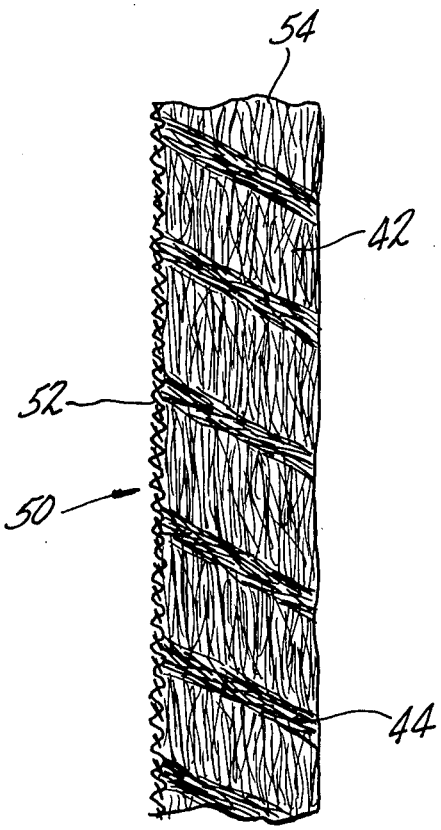

Layered support fabric 50, shown in FIG. 8, has as a first layer 52, a highly porous fabric. Contiguous to first layer 52 is second layer 54 having fiber clusters 44 on a diagonal to the generally vertically oriented fibers 42.

Figure 9:
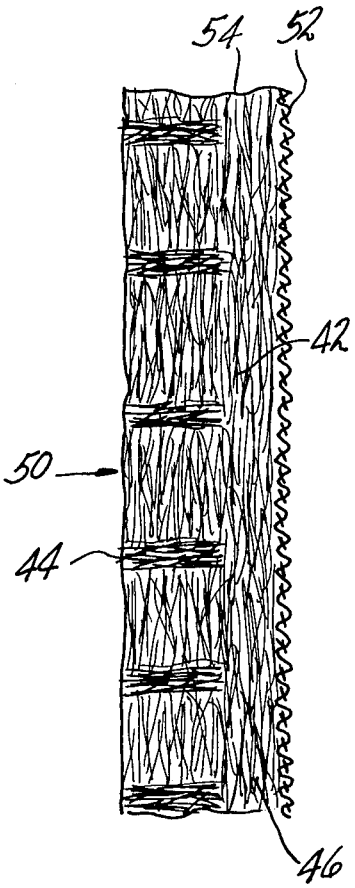

The embodiment of layered support fabrics 50 illustrated in FIG. 9 has first layer 52 of a highly porous fabric non-adjacent to second layer 54. Second layer 54 has fiber clusters 44 partially penetrating second layer 54. Section 46, having fibers generally oriented in a vertical direction is adjacent to first layer 52.

More in detail, the novel diaphragms of the present invention comprise a support fabric which is impregnated with montmorillonite clay.

A fabric is employed which is produced from materials which are chemically resistant to and dimensionally stable in the gases and electrolytes present in the electrolytic cell. The fabric support is substantially non-swelling, non-conducting and non-dissolving during operation of the electrolytic cell. The fabric support is also non-rigid and is sufficiently flexible to be shaped to the contour of an electrode if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degradation or damage.

Support fabrics having uniform permeability throughout the fabric are quite suitable in diaphragms of the present invention. FIG. 4 illustrates support fabrics of this type. Prior to impregnation with the montmorillonite clay, these support fabrics should have a permeability to gases such as air of, for example, from about 5 to about 500, preferably from about 20 to about 200 and more preferably from about 30 to about 100 cubic feet per minute per square foot of fabric. Uniform permeability throughout the support fabric is not, however, required and it may be advantageous to have a greater permeability in one portion of the support fabric. When impregnated, this portion may be positioned closest to, for example, the anode in the electrolytic cell. Layered structures thus may be employed as support fabrics having, a first layer which when the diaphragm is installed in the cell, will be in contact with the anolyte, and a second layer which will be in contact with the catholyte. The first layer may have, for example, an air permeability of, for example, from about 100 to about 500 cubic feet per minute. The first layer may be, for example, a net having openings which are slightly larger than the particle size of the montmorillonite clay with which it is impregnated.

The second layer, in contact with the catholyte when installed in the cell may, for example, have an air permeability of from about 5 to about 100 cubic feet per minute. For the purpose of using a selected size of particles of montmorillonite clay, the layered support fabric can be produced by attaching, for example, a net to a felt fabric. The net permits the particles to pass through and these are retained on the felt.

Permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. Preferred forms of support fabric are felt fabrics, i.e., fabrics having a high degree of interfiber entanglement or interconnection which are usually non-woven. When employing felt as a support fabric, fluids passing through the fabric take a tortuous route through the randomly distributed, highly entangled fibers. The permeability of these fabrics is of a general nature, i.e., non-linear and non-controlled.

Permeability of these support fabrics may be increased by means which alter the structure of the support fabric. As illustrated in FIGS. 5–9, the support fabrics have been modified by providing means for linear permeability, for example, fiber bundles distributed throughout the support fabric. Spaced apart at regular or irregular intervals, the fiber bundles improve permeability by providing regions through which the flow of fluids such as alkali metal chloride brines is substantially laminar. Laminar flow reduces turbulence or mixing of fluids in the region and results in a homogeneous fluid throughout the region.

To provide fiber bundles in the support fabric, the fabric is, for example, needled or punched at intervals along the surface of the fabric. The depth of the needling may be controlled to provide fiber bundles which penetrate through the fabric, as shown in FIGS. 5–6 and 8, or fiber bundles which only partially penetrate the fabric, as illustrated in FIGS. 7 and 9.

Fiber bundles may be positioned at any suitable angle to the plane of the outer surface of the support fabric. For example, the angle of the fiber bundles may be from about 90 to about 45 degrees from the vertical and preferably from about 90 to about 60 degrees.

Fiber bundles contain a plurality of fibers, for example, up to several hundred fibers may comprise a bundle. The bundles are distributed throughout the support fabric, which may contain several hundred bundles per square inch of fabric.

The fiber bundles provide linear permeability which substantially increases the permeability of the support fabric. Any suitable amount of total permeability of the support fabric may be provided by the inclusion of fiber bundles. For example, fiber bundles may provide from about 15 to about 70 percent of the permeability of the support fabric. Preferably, fiber bundles provide from about 20 to about 50 and more preferably from about 30 to about 40 percent of the permeability of the support fabric.

In addition to improving the permeability, the fiber bundles facilitate the impregnation of the support fabric with the montmorillonite clay and aid in providing a more uniform distribution of the clay composition within the support fabric.

A further advantage of the presence of fiber bundles in the support fabric is that electrical resistance is reduced.

Materials which are suitable for use in preparing support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride and copolymers of ethylenechlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Fabrics which are mixtures of fibers of polyolefins and fibers of polyarylene sulfides can be suitably used as well as layered support fabrics in which the first layer is a polyolefin such as polytetrafluoroethylene and the second layer is a polyarylene sulfide such as polyphenylene sulfide.

The support fabric is impregnated with the active component of the novel diaphragm of the present invention which is an inorganic layer of the montmorillonite group. Montmorillonite has as its theoretical empirical formula: $Al_4Si_8O_{24}H_4.xH_2O$ it, however, normally includes other elements such as Mg, Ca, Na, and Fe. Bentonite, which is essentially montmorillonite, is a preferred embodiment of clays of the montmorillonite group. Suitable examples of bentonite include sodium bentonite, also known as Wyoming bentonite, and calcium bentonite. Sodium bentonite has a high swelling capacity in liquids such as water or alkali metal chloride brines. While having lower swelling capacities in these liquids, calcium bentonite's swelling properties may be increased by activation, for example, with sodium carbonate. Also suitable as the active component in the porous diaphragm are other montmorillonite clays such as nontronite, hectorite, and saponite.

Montmorillonite clays are species of siliceous compositions having the formula:

$$(X)_m(Si)_p(O)_q(H)_r nH_2O \qquad \text{I}$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4p; and n is zero to about 30.

Additional siliceous compositions of Formula I in which m is a positive number include silicates of beryllium, magnesium, calcium, strontium, or barium where the ratio of the metal to silicon is no greater than about 1:1. Suitable compositions include magnesium-containing minerals such as sepiolites, meerschaums, augites, talcs, and vermiculites; calcium-containing minerals such as wollastonite; as well as minerals such as tremolite having the formula $CaMg_3(SiO_3)_4$. Also suitable are synthetic silicates such as commercial magnesium silicates having the approximate composition $2MgO.3SiO_2.2H_2O$, as well as calcium silicate hydrate having the approximate composition $CaO.3.5SiO_2.1.8H_2O$.

Also suitable are synthetic clay materials which are described, for example, in U.S. Pat. Nos. 3,586,478 and 3,671,190 issued to B. S. Neumann; U.S. Pat. Nos. 4,040,974 and 4,054,537 issued to A. C. Wright et al; U.S. Pat. No. 3,666,407 issued to J. K. Orlemann; U.S. Pat. No. 3,844,979 issued to D. A. Hickson; or U.S. Pat. No. 3,855,147 issued to W. T. Granquist.

Suitable representatives of siliceous compositions of Formula I where the metal is Ti or Zr include zirconium silicates and benitoite ($BaTiSi_3O_9$).

Where X is aluminum, siliceous compositions of Formula I, in addition to montmorillonite clays, include aluminum silicates, minerals such as albites, feldspars, labradorites, microclines, nephelines, orthoclases, pyrophyllites, and sodalites; as well as natural and synthetic zeolites.

Synthetic silicate minerals such as those described in U.S. Pat. No. 3,252,757 issued to W. T. Granquist or U.S. Pat. No. 3,252,889 issued to R. G. Capell et al are suitable aluminum-containing compositions.

Also suitable are inorganic compositions in which X is zinc, such as zinc silicates.

Siliceous compositions of Formula I may also include supplementary elements, such as vanadium, niobium, rare earth elements of the lanthanide series, germanium, tin and tungsten. Further, alkali metals such as sodium, potassium and lithium and their oxides are frequently present in siliceous materials suitable as compositions of Formula I. When present in siliceous compositions of Formula I, the above supplementary elements do not represent X and are therefore not included in the determination of m.

In Formula I, where m and r are zero, suitable siliceous compositions are silica-containing materials which are suitably represented by sand, quartz, silica sand, colloidal silica as well as cristobalite, tripolite and chalcedony. The term "sand" includes compositions having a silicon dioxide content of at least about 95 percent by weight.

As indicated by Formula I, the siliceous compositions may be in the form of a hydrate and various amounts of water of hydration can be present.

Siliceous compositions of Formula I may be formed in situ by the interaction of salts of Be, Mg, Ca, Ser, Ba, Ti, Zr, Al and Zn with, for example, silica or an alkali metal silicate. Where X is magnesium, magnesium compounds such as magnesium acetate, magnesium aluminate, magnesium carbonate, magnesium chloride and magnesium peroxide can be employed. For example, a mixture of the appropriate amounts of magnesia (MgO) with silica in the presence of a cell electrolyte such as an alkali metal hydroxide will produce a siliceous composition of Formula I.

The presence of metals other than those included in Formula I or discussed above as supplementary elements can be tolerated at low concentrations. For example, the concentration of metals such as Fe, Ni, Pb, Ag as well as other heavy metals which may be present in alkali metal chloride brines suitable for electrolysis are preferably below one part per million. Where these metals are present in minerals suitable as siliceous compositions of Formula I, it is preferred that their concentration be less than about 5 percent of the concentration of silicon present in the material.

Similarly, non-metallic materials such as ammonia as well as organic compounds, if present, should be limited to moderate or preferably low levels of concentration.

The degree to which the siliceous composition of Formula I is hydrated serves as a basis for selecting suitable particle sizes. For those compositions which are readily hydrated in the electrolyte solutions used or produced in the cell, a particle size as large as about 1000 microns is satisfactory. Where the component is less easily hydrated, the particle size may be substantially reduced. For these compositions, particles having a size in the range of from about 75 microns to about 0.1 micron are more suitable.

Aqueous solutions of ionizable compounds which are suitable as electrolytes include, for example, alkali metal chlorides and alkali metal hydroxides.

The support fabrics may be impregnated with a montmorillonite group clay such as bentonite in any of several ways. For example, a slurry of the composition in an aqueous solution of an alkali metal hydroxide or an alkali metal chloride is prepared and the support fabric is impregnated by soaking in the slurry. Another method is to attach the supporting fabric to the cathode and immerse the cathode in the slurry, using the fabric as a filter cloth. Suction means are employed to draw the slurry through the support fabric where the solid particles impregnate the fabric and the filtrate is withdrawn.

In a further embodiment, the support fabric may be impregnated with the siliceous composition by employing means such as rollers to contact the support fabric with the slurry.

It is not necessary to employ a solution or slurry for impregnation purposes. For example, the montmorillonite clay compositions may be used to form a fluidized bed. A vacuum is employed to suck the particles into the support fabric until the desired degree of impregnation is obtained.

When impregnated, the novel diaphragm of the present invention contains from about 10 to about 100, preferably from about 25 to about 75, and more preferably from about 30 to about 50 milligrams of the montmorillonite group clay per square centimeter of support fabric.

Following impregnation with the inorganic clay composition, the diaphragms have a permeability to alkali metal chloride brines of from about 100 to about 1000, and preferably from about 200 to about 500 milliliters per minute per square meter of diaphragm at a head level difference between the anolyte and the catholyte of from about 0.1 to about 20 inches of brine.

In order to provide similar brine permeability rates, deposited asbestos fiber diaphragms require a greater density which results in higher electrical resistance as indicated by larger voltage coefficients at comparable operating conditions. The novel diaphragms of the present invention are thus more energy efficient than deposited asbestos diaphragms and provide reduced power costs.

In a further embodiment, the support fabric, the montmorillonite group clay, or the finished diaphragm is treated with a surfactant to reduce the cell voltage required during electrolysis. Nonionic and anionic surfactants can be employed including, for example, fluorochemical surfactants, organic phosphate esters, alkyl sulfonates, alkyl aryl sulfonates, alcohol ethoxylates, polyoxyethylene alcohols, polyoxyethylene alkylphenols, and silicone based surfactants.

Preferred nonionic and anionic surfactants are fluorochemical surfactants such as those based on perfluorinated fatty acids or alcohols. These fluorochemical surfactants are available commercially and sold, for example, by the 3M Company under the trademark Fluorad® including FC-93, FC-95, FC-128, and FC-170 or by E. I. duPont de Nemours and Company under the trademark Zonyl® (Zonyl® FSA, FSP, or FSN).

The support fabric may be treated with the surfactant in any suitable manner including soaking the fabric in a solution containing the surfactant or spraying the support fabric with the solution. Following this treatment, the support fabric is dried to remove any solvent present in the surfactant solution.

These surfactants may similarly be used to treat a montmorillonite clay such as bentonite. For example, addition of the surfactant to an alkali metal chloride brine containing bentonite particles aids in the suspension of the bentonite in the brine by improving the colloidal behavior of these particles. There is a significant reduction in the settling out of bentonite particles from the brine along with substantial increases in particle volume.

Treatment of the support fabric impregnated with the montmorillonite clay with the surfactant may also be carried out, for example, by soaking or spraying the diaphragm with a surfactant solution.

The novel diaphragms of the present invention have handling properties which far exceed those of, for example, asbestos. The supported diaphragms can be removed from the cell, washed or reduced to restore flowability and replaced in the cell without physical damage. During operation of the cell, the novel diaphragms remain dimensionally stable with the support material neither swelling nor being dissolved or deteriorated by the electrolyte, the siliceous composition or the cell products produced.

Electrolytic cells in which the diaphragms of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal or graphite anodes, a cathode assembly having a plurality of foraminous metal cathodes with the novel diaphragm separating the anodes from the cathodes. Suitable electrolytic cells which can utilize the novel diaphragms of the present invention include, for example, those types illustrated by U.S. Pat. Nos. 1,862,244; 2,370,087; 2,987,463; 3,247,090; 3,477,938; 3,493,487; 3,617,461; and 3,642,604.

Diaphragms of the present invention may also be suitably used, for example, in cells which electrolyze alkali metal hydroxides to produce hydrogen and oxygen.

When employed in electrolytic cells, the diaphragms of the present invention are sufficiently flexible so that they may be mounted on or supported by an electrode such as a cathode.

During electrolysis of alkali metal chloride solutions, the montmorillonite clay compositions produce a gel-like formation which is permeable to alkali metal ions. While the gel-like formations may be produced throughout the diaphragm they are normally produced within the support fabric in the portion which is adjacent to the anolyte side. The extent of gel formation within the support fabric varies, for example, with the thickness of the support fabric and the concentration of alkali metal hydroxide in the catholyte liquor. Preferred diaphragms are those which have a gel-free portion in contact with the catholyte.

Gel-free portions of the diaphragm are attained, for example, by controlling the areas of the support fabric which are impregnated with the clay composition or by controlling the concentration of the electrolytes in the anode and cathode compartments.

Gel formation is believed to occur during hydration of the clay composition. The gel is believed to be soluble in the catholyte liquor and it is desirable that the rate of dissolution be controlled to maintain a suitable equilibrium between gel formation and dissolution for efficient operation of the cell.

Employing a montmorillonite group clay such as bentonite, the gel formed is highly stable and has a low rate of dissolution. In addition, the gel has a high ion exchange capacity which results in high current efficiencies for the electrolysis process. The stability of the bentonite gel results in cell operation at high current efficiencies and low cell voltages where fluctuations due to changes in operating conditions, particularly sudden changes, are minimized. For example, a change in the feed rate of brine to the anode compartment or a change in the acidity or alkalinity of brine fed to the cell has little effect on bentonite gels and does not cause significant changes in the cell's current efficiencies or voltages. Alkali metal chloride brines which are highly acid, e.g. pH 2–4 or alkaline, e.g. pH 9–14 may be employed with these novel diaphragms.

Hydraulic properties of the novel diaphragm of the present invention with montmorillonite clays allows continuous operation of the cell for extended periods to produce a controlled range of alkali metal hydroxide concentrations at optimum efficiencies with only moderate changes in the head level. These diaphragms have a low degree of compressibility and are resistant to pressure changes to the extent that the rate of brine flow through the porous diaphragm during cell operation is substantially directly proportional to the head level. Unlike asbestos diaphragms, whose degree of compressibility is ever increasing during its operating life, the compressibility of the diaphragms of the present invention changes only slightly during cell operation.

Where supplemental addition of the impregnating agent is employed during cell operation, the frequency of addition is low and the amounts required are small when bentonite is used.

The porous diaphragms of the present invention are illustrated by the following examples without any intention of being limited thereby.

EXAMPLE 1

A dispersion of bentonite on sodium chloride brine was prepared in a blender containing about 5 percent by volume of bentonite (Benton Clay Co. "Thixojel", Wyoming bentonite clay particle size range 80–800 microns). Analysis of the bentonite indicated oxides of the following elements were present as percent by weight: Si 66.80; Al 16.40; Mg 1.84; Ca 2.77; Fe 3.44; Na 2.48; K 0.44.

A section of polytetrafluoroethylene felt of the type of FIG. 4, 0.05 of an inch thick, was washed in an aqueous caustic soda solution containing 15–20 percent NaOH and at a temperature of 30° C. for about 24 hours to remove residues and improve wettability. The felt was then fitted on a steel mesh cathode. The felt-covered cathode was immersed in the brine (pH 8) containing 1 percent by volume of bentonite and a vacuum applied to impregnate the felt with the dispersion until a vacuum of 20 to 22 inches was reached. The vacuum was shut off and the procedure repeated three times.

The impregnated, felt-covered cathode was installed in an electrolytic cell employing a ruthenium oxide coated titanium mesh anode and sodium chloride brine at a pH of 8, a concentration of 300±5 grams of NaCl per liter and a temperature of 90° C. Current was passed through the brine at a density of 2.16 kiloamps per square meter of anode surface. The initial brine head level was 0.5 to 1 inch greater in the anode compartment than in the cathode compartment. After about 0.5 hour of cell operation, the premixed dispersion of bentonite in the brine was added to the anolyte. The permeability of the impregnated diaphragm was found to be in the range of from about 200 to about 250 milliliters per square meter of diaphragm by measuring the rate of catholyte liquor produced. The amount added corresponded to about 7 percent of the total volume of anolyte, the addition being made without interruption of the electrolysis process. The head level increased to 2.5 to 3 inches during the next few hours of operation. The cell was operated for 30 days at current efficiencies in the range of 91–96 percent at a cell voltage of 3.1 to 3.2 volts and a power consumption of 2250 to 2350 kilowatt hours per ton of $Cl_2$.

The catholyte liquor produced had a sodium hydroxide concentration in the range of 114 to about 137 grams per liter and a sodium chloride concentration in the range of 140 to 182 grams per liter.

EXAMPLE 2

A section of polytetrafluoroethylene felt of the type of FIG. 4 having a thickness of 0.045 of an inch was washed in caustic soda solution by the procedure of EXAMPLE 1. The felt was fitted on a steel mesh cathode and impregnated with the bentonite dispersion of EXAMPLE 1 by immersing the felt in the dispersion and rolling the dispersion into the felt with a pair of rollers. The impregnated felt covered cathode was installed in the cell of EXAMPLE 1. During the 50 days of cell operation, current efficiency based on the catholyte liquor was 91 to 96 percent at a cell voltage of 3.1–3.15 and a current density of 2.2 kiloamps per square meter. The head level maintained in the anode compartment was in the range of 1.5–2.75 inches of brine.

EXAMPLE 3

A section of felt fabric of polytetrafluoroethylene having a thickness of 0.10 of an inch was employed as the support fabric. The surface of the fabric was needled to provide several hundred bundles of fibers containing about 100 fibers per bundle per square inch of fabric. The fiber bundles penetrated the entire thickness of the felt fabric and were substantially perpendicular to the plane of the felt surface. This provided the felt fabric with a linear permeability which represented from about 30 to about 35 percent of the total permeability of the fabric.

The felt section was washed in caustic solution, impregnated and installed in an electrolytic cell using the procedure of EXAMPLE 1. Using the sodium chloride brine and electrolytic procedure of EXAMPLE 1, the cell was operated for 54 days. Cathode current efficiencies of 90 to 95 percent were achieved at a current density of 2.16 kiloamps per square meter and a cell voltage of 3.75±0.05 volts.

EXAMPLE 4

A polytetrafluoroethylene felt fabric of the type of FIG. 4 0.125 of an inch thick was sprayed with a fluorochemical surfactant (E. I. duPont de Nemours and Company—Zonyl® FSN). The sprayed felt was allowed to dry and then treated and impregnated with bentonite using the procedure of EXAMPLE 1. The diaphragm-covered cathode was installed in a cell of the type of EXAMPLE 1 and sodium chloride brine electrolyzed by the procedure of EXAMPLE 1. During the 21 days of operation, the cell voltage was in the range of 3.5 to 3.6 at a current density of 2.3 kiloamps per square meter. Cathode current efficiency was 90 to 91 percent in producing a caustic liquor having a concentration of 122 to 132 grams per liter of NaOH.

EXAMPLE 5

The procedure of EXAMPLE 4 was repeated using a section of polytetrafluoroethylene 0.19 of an inch thick. At a current density of 2.3 kiloamps per square meter, the cathode efficiency during the 31 days of cell operation was in the range of 94 to 96 percent at a cell voltage of 3.7 volts.

What is claimed is:

1. A porous diaphragm for use in the electrolysis of aqueous solutions of ionizable compounds in electrolytic diaphragm cells comprises a support fabric impregnated with particles of an inorganic clay of the montmorillonite group.

2. The porous diaphragm of claim 1 in which said support fabric is a thermoplastic material.

3. The porous diaphragm of claim 2 in which said support fabric has a permeability to air of from about 5 to about 500 cubic feet per minute per square foot of fabric.

4. The porous diaphragm of claim 3 in which said support fabric is a polyolefin selected from the group consisting of olefins having from 2 to about 6 carbon atoms and their chloro- and fluoro- derivatives.

5. The porous diaphragm of claim 4 in which said support fabric is a polyolefin selected from the group consisting of polypropylene, polytetrafluoroethylene, fluorinated ethylene-propylene, polychlorotrifluoroethylene, polyvinyl fluoride, and polyvinylidene fluoride.

6. The porous diaphragm of claim 5 in which said support fabric is selected from the group consisting of polytetrafluoroethylene and polyvinylidene fluoride.

7. The porous diaphragm of claim 3 in which said support fabric is a polyarylene sulfide selected from the group consisting of polyphenylene sulfide, polynaphthalene sulfide, poly(perfluorophenylene) sulfide, and poly(methylphenylene) sulfide.

8. The porous diaphragm of claim 6 or 7 in which said support fabric is a felt fabric.

9. The porous diaphragm of claim 8 in which said inorganic clay of said montmorillonite group is bentonite.

10. The porous diaphragm of claim 9 in which said support fabric is treated with a fluorochemical surfactant.

11. The porous diaphragm of claim 9 in which said bentonite is treated with a fluorochemical surfactant.

12. The porous diaphragm of claim 8 in which said support fabric has fiber bundles containing a plurality of fibers to provide linear permeability to fluids.

13. In an electrolytic diaphragm cell for the electrolysis of aqueous solutions of ionizable compounds, said cell having an anode assembly containing a plurality of anodes, a cathode assembly having a plurality of cathodes, a diaphragm separating said anode assembly from said cathode assembly, and a cell body housing said anode assembly and said cathode assembly, the improvement which comprises a porous diaphragm comprising a support fabric impregnated with particles of an inorganic clay of the montmorillonite group.

14. The electrolytic diaphragm cell of claim 13 in which said inorganic clay of said montmorillonite group is bentonite.

* * * * *

UNITED STATES PATENT AND TRADEMARK OFFICE

CERTIFICATE OF CORRECTION

PATENT NO. : 4,278,524

DATED : July 14, 1981

INVENTOR(S) : Igor V. Kadija

It is certified that error appears in the above-identified patent and that said Letters Patent are hereby corrected as shown below:

In Column 1, lines 65-66, delete "monmorillonite" and insert --montmorillonite--.

In Column 5, line 19, delete "layer" and insert --clay--.

In Column 5, line 21, after "$Al_4Si_8O_{24}H_4$" insert one space and --•-- and one space after the sign.

In Column 5, Formula I, line 38, after "$(X)_m(Si)_p(O)_q(H)_r$" insert one space and --•-- and one space after the sign.

In Column 5, line 59, after "2MgO" insert one space and delete the "." and add --•-- and a space after the sign.

In Column 5, line 60, after "$O_2$", insert one space and delete the "." and add --•-- and a space after the sign.

In Column 5, line 61, after "CaO", insert one space and delete "." and insert --•-- and one space after the sign.

In Column 5, line 61, after "$CaO.3.5SiO_2$" insert one space and delete "." and insert --•-- and one space after the sign.

UNITED STATES PATENT AND TRADEMARK OFFICE

CERTIFICATE OF CORRECTION

PATENT NO. : 4,278,524

DATED : July 14, 1981

INVENTOR(S) : Igor V. Kadija

It is certified that error appears in the above-identified patent and that said Letters Patent are hereby corrected as shown below:

In Column 6, line 37, delete "Ser" and insert --Sr--.

In Column 8, line 20, delete "reduced" and insert --treated--.

In Column 9, Example 1, line 50, delete "on" and insert --in--.

Signed and Sealed this

Thirtieth Day of March 1982

[SEAL]

Attest:

GERALD J. MOSSINGHOFF

Attesting Officer

Commissioner of Patents and Trademarks